US011203095B2

(12) United States Patent
Jin et al.

(10) Patent No.: US 11,203,095 B2
(45) Date of Patent: Dec. 21, 2021

(54) FLEXIBLE SANDING DEVICE FOR CYLINDER ROCK SPECIMEN

(71) Applicant: Taiyuan University of Technology, Shanxi (CN)

(72) Inventors: Zhixin Jin, Shanxi (CN); Chunwang Zhang, Shanxi (CN); Guorui Feng, Shanxi (CN); Xuanmin Song, Shanxi (CN); Shengyong Hu, Shanxi (CN); Yujiang Zhang, Shanxi (CN); Tingye Qi, Shanxi (CN); Zhen Li, Shanxi (CN)

(73) Assignee: Taiyuan University of Technology, Taiyuan (CN)

( * ) Notice: Subject to any disclaimer, the term of this patent is extended or adjusted under 35 U.S.C. 154(b) by 531 days.

(21) Appl. No.: 16/208,592

(22) Filed: Dec. 4, 2018

(65) Prior Publication Data

US 2019/0168357 A1 Jun. 6, 2019

(30) Foreign Application Priority Data

Dec. 4, 2017 (CN) ..... 201711259003.7

(51) Int. Cl.

| | |
|---|---|
| ***B24B 7/16*** | (2006.01) |
| ***B24B 7/17*** | (2006.01) |
| ***B24B 7/22*** | (2006.01) |
| ***B24B 23/02*** | (2006.01) |
| ***B24B 23/08*** | (2006.01) |
| ***B24B 41/06*** | (2012.01) |

(Continued)

(52) U.S. Cl.

CPC ..... *B24B 41/067* (2013.01); *B24B 7/08* (2013.01); *B24B 7/16* (2013.01); *B24B 7/17* (2013.01); *B24B 7/22* (2013.01); *B24B 23/02* (2013.01); *B24B 23/08* (2013.01); *B24B 27/0076* (2013.01); *B24B 41/066* (2013.01)

(58) Field of Classification Search

CPC .... B24B 7/08; B24B 7/16; B24B 7/17; B24B 7/22; B24B 23/08; B24B 27/0023; B24B 27/0076; B24B 41/066; B24B 41/067

USPC ..... 451/344, 345, 360, 903, 261, 262

See application file for complete search history.

(56) References Cited

U.S. PATENT DOCUMENTS 5,038,525 A * 8/1991 Gardner ..... B24B 9/007 451/439
6,964,077 B2 * 11/2005 Kadinger ..... B08B 9/021 15/104.03

(Continued)

FOREIGN PATENT DOCUMENTS

| | | |
|---|---|---|
| CN | 102672828 B | 10/2014 |
| CN | 205465642 U | 8/2016 |
| CN | 106903809 B | 8/2018 |

*Primary Examiner* — Eileen P Morgan

(57) ABSTRACT

A rock sanding device includes a base, a bottom sanding plate, an adjustable connecting rod, an elastic loader, a connector, a side sanding brush, a top sanding plate, an inner rod, a prong and a drill rod. The top of the drill rod is fixedly connected with the rotating shaft of the external water drilling rig and the external water drilling rig has a water inlet joint to introduce water into the drill rod. The inner rod and drill rod are connected and fixed coaxially, and the bottom of the drill rod is symmetrically welded with four prongs. The rock specimen is placed in the center of the side sanding brush. The top sanding plate and the bottom sanding plate are provided in the top side and bottom side of the rock specimen, respectively.

6 Claims, 4 Drawing Sheets

(51) Int. Cl.
*B24B 7/08* (2006.01)
*B24B 27/00* (2006.01)

(56) References Cited

U.S. PATENT DOCUMENTS

| | | | | |
|---|---|---|---|---|
| 7,607,187 | B2 * | 10/2009 | Vargas | B08B 9/021 15/104.02 |
| 8,613,642 | B2 * | 12/2013 | Bowles | B24B 39/045 451/51 |
| 9,498,825 | B2 * | 11/2016 | Robeson | B08B 9/021 |
| 2003/0054745 | A1 * | 3/2003 | Bergquist | B24D 7/10 451/540 |
| 2007/0006409 | A1 * | 1/2007 | Vargas | B24B 29/005 15/104.04 |
| 2009/0209178 | A1 * | 8/2009 | Vargas | B24B 23/02 451/51 |
| 2014/0187127 | A1 * | 7/2014 | Zapp | B24B 47/12 451/59 |

* cited by examiner

FLEXIBLE SANDING DEVICE FOR CYLINDER ROCK SPECIMEN

CROSS-REFERENCE TO RELATED APPLICATIONS

This application claims to Chinese Application No. 201610452723.4 with a filing date of Jun. 21, 2016. The content of the aforementioned application, including any intervening amendments thereto, is incorporated herein by reference.

TECHNICAL FIELD

The present disclosure relates to a rock sanding device, and in particular to a flexible sanding device for cylinder rock specimen.

BACKGROUND

The standard cylinder specimens are often used in many rock mechanics tests, such as the uniaxial compression test and the Brazilian splitting test. The geometrical shape of the specimen is cylinder. Most of the cylinder specimens are obtained by core-drilling to coal-rock mass of project spots. On the one hand, the side of the drilled cylinder rock core is often rough, on the other hand, the diameter of the drilled cylinder rock core is generally longer than the diameter of what the rock mechanics test needs, therefore, a further process is needed to make the standard specimen for the rock mechanics from the drilled rock core, for example, the diameter and height of the standard cylinder specimens in the uniaxial compression test are 50 mm and 100 mm, respectively, and the accuracy should satisfy the two conditions: the error of the diameter cannot exceed 0.3 mm in the whole height and the parallelism errors of the ends cannot exceed 0.05 mm. It can be seen that the rock mechanics test demands a high dimensional accuracy of the specimen. Meanwhile, the dimensional accuracy of the specimen in rock mechanics test has a certain influence on result of the test.

Therefore, it is very important to sand the cylinder rock specimen.

Wherein the sanding process of the cylinder rock specimen includes the sanding to the ends of the cylinder rock specimen and the sanding to the side of the cylinder rock specimen, and at present, it is processed and sanded according to the two parts. Since the ends of cylinder rock specimen is flat, it is easy to process and sand, at present, the processing and sanding of the ends includes: first, cutting the cylinder rock with a cutter, then sanding the surface with the sandpaper by manual operation or sanding the ends with the flat sanding machine. Since the side of the cylinder rock specimen is arc-shaped, it is complicated to process and sand, at present, the processing and sanding of the cylinder rock specimen generally includes: fixing the specimen with the rotating rod by the stock-removing machine, and then cutting the circumference by controlling the number of cutters and sanding the side of the rock specimen by manual operation.

The above technique has settled some problems, however, due to the complexity of various rock structures and the fragile characteristic of rock, the cylinder rock specimen is often broken during the processing of the specimen due to the high mechanical strength. For example, when cutting the side of the cylinder rock specimen with the stocking-removing machine, on the one hand, the difference between rock and other cast iron materials and the heterogeneity of the rock caused the appearance of pits on the surface of the rock processed by the stocking-removing machine and the emerging of round and round cutting marks on the side of the cylinder rock, which is unsmooth; on the other hand, when the cutter cuts the side of the cylinder rock, the force mode of the cylinder is point-contact rigid loading, and the rock specimen is easy to suffer secondary damage under the rigid loading, even being broken in severe cases, which not only damages the specimen itself, but also it may damage the stocking-removing machine. At the same time, the sanding process of rock specimen is carried out by manual operation, which is time consuming, labor intensive and low efficiency.

At present, there is no solution to solve the problem of cylinder rock specimen to make the process of sanding convenient, economical, practical and efficient. A flexible sanding device for cylinder rock specimen can achieve highly precise and stable rock specimen processing and sanding with low cost and simple processing technique. Furthermore, it is easy to operate and can protect the cylinder rock specimen well. No related technical report in the prior disclosed references has been found.

SUMMARY

This disclosure provides a flexible sanding device for cylinder rock specimen to make the processing and sanding of cylinder rock specimen convenient, economical, practical and efficient.

This disclosure adopts the following technical solutions: a flexible sanding device for sanding a rock specimen in a shape of a cylinder includes a base, a bottom sanding plate, four adjustable connecting rods, four elastic loaders, four connectors, four side sanding brushes, a top sanding plate, an inner rod, four prongs and a drill rod. The top of the drill rod is fixedly connected with a rotating shaft of an external water drilling rig and the external water drilling rig has a water inlet joint to introduce water into the drill rod. The inner rod is coaxially connected with the drill rod. The four prongs are welded symmetrically around the drill rod. Each of the four adjustable connecting rods is connected to each of the four prongs and is inserted into each of the four connectors. Each of the four connectors is connected to each of the four side sanding brushes. Each of the four elastic loaders is arranged between one of the four adjustable connecting rods and one of the four connectors. The four side sanding brushes are arranged around the rock specimen and configured to sand a lateral surface of the rock specimen. The top sanding plate is connected with the inner rod through a high-strength spring and is configured to sand a first end surface of the rock specimen and the bottom sanding plate is fixed at the center of the base where four convex grooves are evenly distributed on and is configured to sand a second end surface of the rock specimen.

Further, the end of each adjustable connecting rod is provided with a hollow tube. Each elastic loader includes a spring and a convex spherical cylinder. The spring is disposed in the hollow tube, and one end of the spring is connected with the convex spherical cylinder.

Further, the ends of each connector are provided with grooves and a cylinder cavity and a concave hemisphere are provided inside each connector. The convex spherical cylinder matches with the concave hemisphere. A convex body of two ends of the hollow tube is inserted into each connector for rotating connection.

The base whose geometrical shape is flat cylinder with a diameter ranging from 300 mm to 1000 mm and a thickness ranging from 50 mm to 200 mm is fixed on the ground, and the used material should be a wear-resistant, shock-resistant gray cast iron or a hard steel.

The convex grooves are evenly distributed on the base and the bottom of the grooves are distributed in the center of cylinder base. The length of each groove is 130-400 mm. The upper width and the lower width of the convex groove is 5-20 mm and 9-20 mm, respectively.

A sanding piece or a coating material is in the top the bottom sanding plate, which is horizontally fixed on the cylinder. The diameter of the sanding piece can be determined by the size of to be sanded specimen and the thickness of the sanding piece is 5-20 mm. The diameter and the height of the cylinder are 20-50 mm and 15-50 mm, respectively.

One end of the adjustable connecting rod is a threaded rod and the other end is a hollow tube. The diameter and the length of the threaded rod are 5-20 mm and 50-200 mm, respectively. The outer diameter and the length of the hollow tube is 10-26 mm and 30-80 mm, respectively. The top of the threaded rod is a quadrangular cylinder with the height ranging from 5 mm to 15 mm. The ends of the hollow tube are symmetrically welded with two cylinder convex bodies with the diameter ranging from 2 mm to 3 mm and the height ranging from 2 mm to 4 mm.

The elastic loader consists of the spring and the convex spherical cylinder, wherein one end of the spring is placed in the hollow tube of the adjustable connecting rod and the other end is connected with the convex spherical cylinder. The diameter and the length of the spring matched with the hollow tube are 8-24 mm and 50-100 mm, respectively; the height of the convex spherical cylinder is 5-8 mm and the diameter of the convex hemisphere is 4-8 mm.

The connector connects the side sanding brush with the adjustable connecting rod. The length of side and the height of the connector are 16-30 mm and 18-40 mm, respectively. The ends of the connector are provided with grooves and inside of the connector is a cavity. The convex spherical cylinder of the elastic loader matches with the concave hemisphere inside of the connector, and the convex body of two ends of the hollow tube is inserted into the connector for rotating connection.

The side of the specimen is sanded by the side sanding brush. The end of the side sanding brush is an arc-shaped sanding piece or a sanding coating. The thickness, height and the arc length of the side sanding brush are 5-8 mm, 20-120 mm and 10-20 mm, respectively, and the height of the side sanding brush can be determined by the size of the specimen.

The top sanding plate is a thin cylinder with the sanding piece or the sanding coating on the inner side. The diameter and the thickness of the top sanding plate are 20-50 mm and 5-20 mm, respectively.

One end of the inner rod is coaxially connected with the drill rod with the diameter ranging from 20 mm to 30 mm, and the height of the inner rod beyond the drill rod is 35-60 mm; the other end of the inner rod is connected with the top sanding plate by the high-strength spring.

The top of the drill rod and the external water drilling rig are tightened by a wrench and the external water drilling rig is the dynamic source for rotating. The drill rod is a hollow tube with the outer diameter ranging from 28 mm to 63 mm and thickness of the side being 7 mm. The lower part of the drill rod is symmetrically welded with at least four prongs, and the end of the prong has the threaded hole matched with the threaded rod.

Compared with the prior art, this disclosure has the following advantages:

(1) The manufacturing technique of the parts of the flexible sanding device for cylinder rock specimen is easy and it can be manufactured by general precision casting machine, which can avoid the complex manufacturing technique.

(2) The flexible sanding device for cylinder rock specimen adopts the method of fixing the specimen in the center and the flexible loading of the high-strength spring to the ends and side of the cylinder rock specimen, which avoids the pluralities of perturbation to the rock specimen.

(3) The specimen can finish sanding at one time with the flexible sanding device for cylinder rock specimen because it doesn't need to sand the ends and the sides separately, which greatly reduces the operation difficulty and saves the time.

(4) The flexible sanding device for cylinder rock specimen can be adjusted according to the geometric dimensions of the specimen, therefore, it can adopt the sanding of various cylinder rock specimens. At the same time, it adopts the symmetrically rotary sanding method on the side of the specimen to guarantee the precision of the rock specimen.

(5) The application of the flexible sanding device for cylinder rock specimen can make the sanding process of the cylinder rock specimen convenient and efficient. The structure of it can reduce the force of the rock specimen by flexible loading and can further reduce the damage rate of the rock specimen, which will reduce the processing cost.

Figure 1:
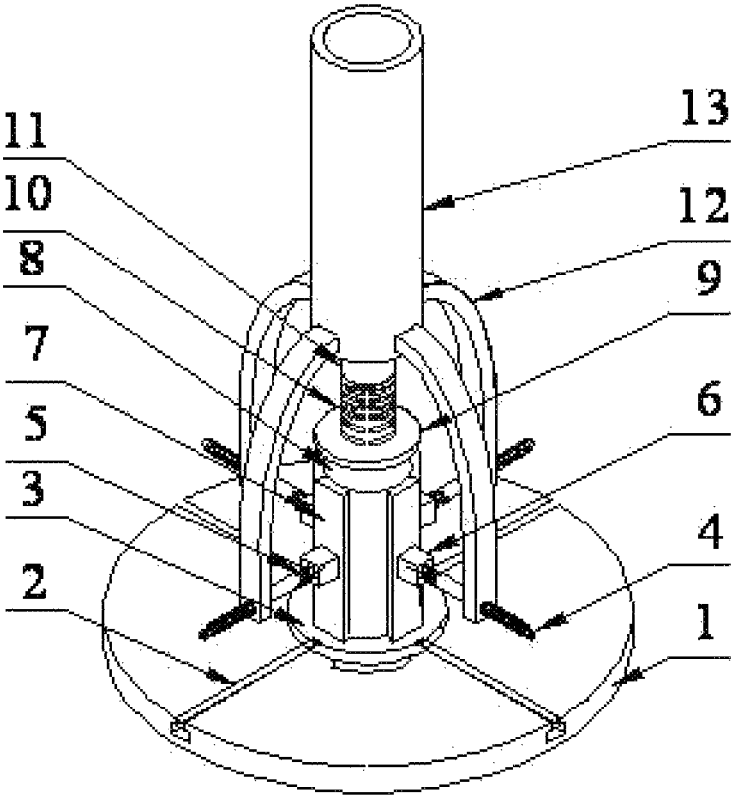
FIG. 1 is a isometric diagram of the flexible sanding device for the cylinder rock specimen.

In the drawings: 1, base; 2, convex groove; 3, bottom sanding plate; 4, adjustable connecting rod; 4.1, hollow tube; 4.2, threaded rod; 4.3, convex body; 5, elastic loader; 5.1, spring; 5.2, convex spherical cylinder; 6, connector; 7, side sanding brush; 8, rock specimen; 9, top sanding plate; 10—high-strength spring; 11, inner rod; 12, prong; 13, drill rod.

DETAILED DESCRIPTION OF EMBODIMENTS

The detailed description of embodiments are further described below with reference to the drawings.

As shown in the isometric diagram of the flexible sanding device for cylinder rock specimen in FIG. 1, the flexible sanding device for cylinder rock specimen includes: a base of the cylinder 1, an embedded convex groove 2, a bottom sanding plate 3, an adjustable connecting rod 4, an elastic loader 5, a connector 6, a side sanding brush 7, a rock specimen 8, a top sanding plate 9, a high-strength spring 10, an inner rod 11, a prong 12, a drill rod 13. Wherein the top of the drill rod 13 and the rotation shaft of the external water drilling rig are tightened by a wrench to connect and fix. At the same time, the external water drilling rig introduces water into the drill rod 13 and the external drill rig is the dynamic source for rotating. The inner rod 11 and the drill rod 13 are fixed and connected coaxially. The bottom of the drill rod 13 is symmetrically welded with four prongs 12.

The side sanding brush 7 is connected with the prong 12 by the adjustable connecting rod 4 and the blocky connector 5. The top sanding plate 9 and the bottom sanding plate 3 are in the top side and bottom side of the specimen, respectively. The top sanding plate 9 is connected with the inner rod 11 by a high-strength spring 10. The bottom sanding plate 3 is fixed in the center of the base 1 and the sanding piece works on the ends of the rock specimen by the elastic force of a high-strength spring 10. The base 1 is placed on a flat ground and four convex grooves 2 are evenly distributed on the base 1. When the motor is rotating, the drill rod 13 drives the prong 12 and the inner rod 11 to rotate and the inner rod 11 drives the top sanding plate 9 to rotate. At the same time, the adjustable connecting rod drives the side sanding brush to rotate, which produces the relative friction movement with the rock specimen to sand the specimen.

Figure 2:
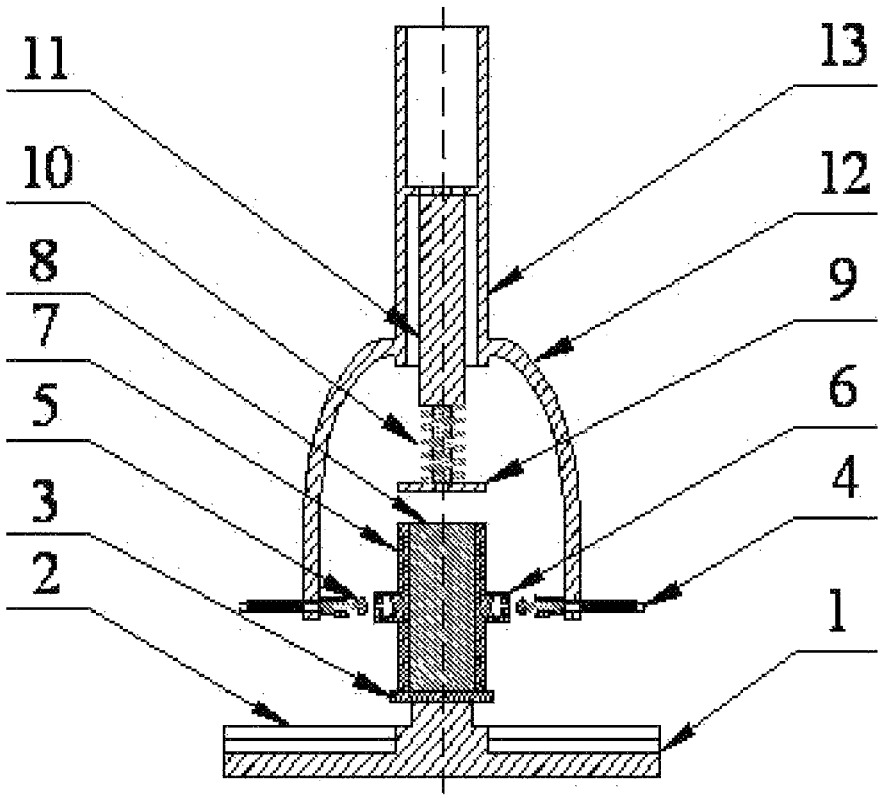
FIG. 2 is a sectional view of the flexible sanding device for the cylinder rock specimen.

As shown in the sectional view of the flexible sanding device for cylinder rock specimen in FIG. 2, the base 1 whose geometrical shape is flat cylinder with the diameter ranging from 300 mm to 1000 mm and the thickness ranging from 50 mm to 200 mm is tightly fixed on the ground, and the used material should be a wear-resistant, shock-resistant gray cast iron or a hard steel. The convex grooves 2 are evenly distributed on the base 1 and the bottom of the grooves is in the center of the cylinder base. The length of each groove is 130-400 mm. The upper width and the lower width of the convex groove are 5-10 mm and 9-20 mm, respectively. A sanding piece or a coating material is in the top of the bottom sanding plate, which is horizontally fixed on the lower cylinder. The diameter of the sanding piece can be determined by the size of to be sanded specimen, and the thickness of the sanding piece is 5-20 mm. The diameter and the height of the cylinder are 20-50 mm and 15-50 mm, respectively. One end of the adjustable connecting rod 4 is a threaded rod and the other end is the hollow tube, wherein the diameter and the length of the threaded rod are 5-20 mm and 50-200 mm, respectively. The outer diameter and the length of the hollow tube are 10-26 mm and 30-80 mm. The top of the threaded rod is a quadrangular cylinder with the height ranging from 5 mm to 15 mm. The ends of the hollow tube are symmetrically welded with two cylinder convex bodies with the diameter ranging from 2 mm to 3 mm and the height ranging from 2 mm to 4 mm. The elastic loader 5 consists of the spring and the convex spherical cylinder, wherein one end of the spring is disposed in the hollow tube of the adjustable connecting rod and the other end is connected with the convex spherical cylinder. The diameter and the length of the spring matched with the hollow tube are 8-24 mm and 50-100 mm, respectively. The height of the convex spherical cylinder is 5-8 mm and the diameter of the convex spherical cylinder is 4-8 mm. The connector 6, which is a block with the length of side ranging from 16 mm to 30 mm and the height ranging from 18 mm to 40 mm, connects the side sanding brush with the adjustable connecting rod. The ends of the connector is provided with grooves and inside of the connector is a cavity. The convex spherical cylinder of the elastic loader matches with the concave hemisphere inside of the connector and the convex body of two ends of the hollow tube is inserted into the connector for rotating connection. The side of the specimen is sanded by the side sanding brush 7 and the end of the side sanding brush 7 is an arc-shaped sanding piece or a sanding coating. The thickness, height and the arc length of the side sanding brush are 5-8 mm, 20-120 mm and 10-20 mm, respectively, and the height can be determined by the size of the specimen. The top sanding plate 9 is a thin cylinder with the sanding piece or the sanding coating on the inner side. The diameter and the thickness of the top sanding plate are 20-50 mm and 5-20 mm, respectively. One end of the inner rod 11 with the diameter ranging from 20 mm to 30 mm and the height beyond the drill rod ranging from 35 mm to 60 mm, is coaxially connected with the drill rod. The other end of the inner rod is connected with the top sanding plate by the high-strength spring. The top of the drill rod 13 and the external water drilling rig are tightened by a wrench, and the external water drilling rig is the dynamic source for rotating. The drill rod is a hollow tube with the outer diameter ranging from 28 mm to 63 mm and thickness of the side being 7 mm. The lower part of the drill rod is symmetrically welded with four prongs and the end of the prong has a threaded hole cooperating with the threaded rod.

Figure 3:
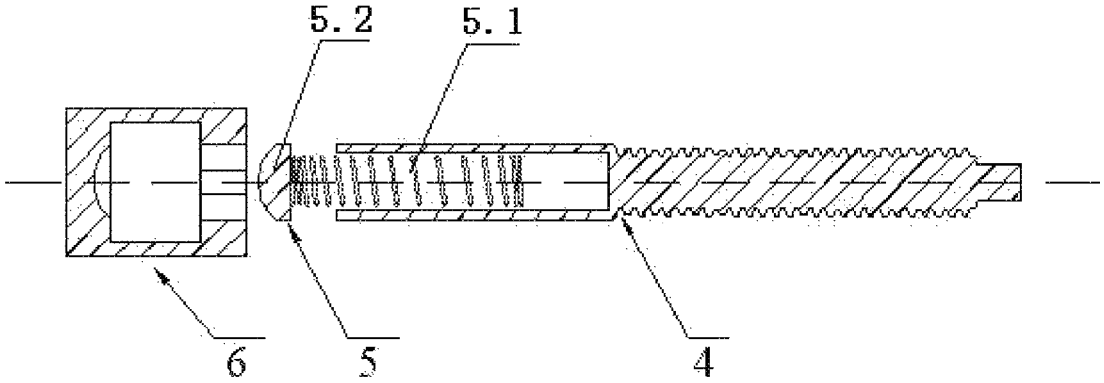
FIG. 3 is a partial enlarged view of the flexible sanding device for the cylinder rock specimen.
Figure 4:
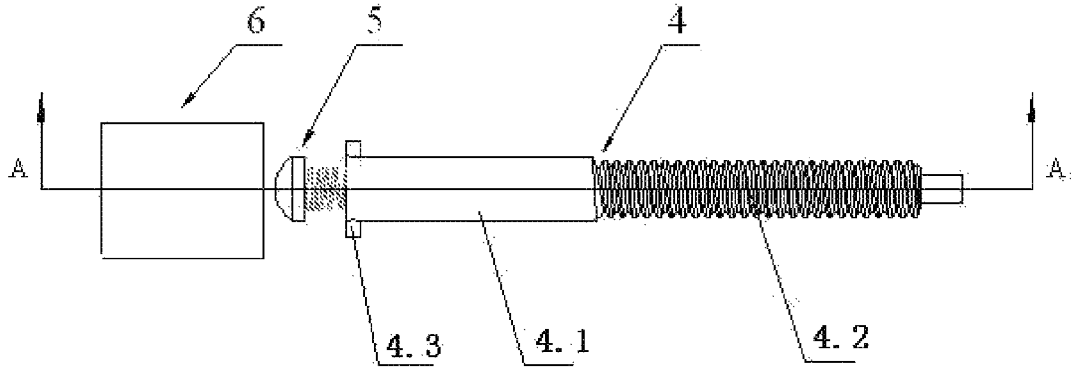
FIG. 4 is another partial enlarged view of the flexible sanding device for the cylinder rock specimen.

As shown in the partial enlargement view of the flexible sanding device for cylinder rock specimen in FIG. 3, it is the assembly diagram of the adjustable connecting rod 4, the elastic loader 5 and the blocky connector 6. The connecting rod rotates in the hole of the end of the prong to move forward by adjusting the block connected with the ends of the threaded rod by the wrench. After the convex body of ends of the hollow tube entered the connector through the grooves of the connector, the hollow tube is rotated to make the convex body of the ends of the tube stuck in the connector, and the convex spherical cylinder works on the concave hemisphere inside the connector by the effect of elastic force of the high-strength spring. At the same time, the hollow tube and the connector can undergo radial movement for flexible loading.

It should be noted that the above embodiments are only for explaining the technical solutions of the present disclosure, and are not for limiting. Although the present disclosure has been described in detail with reference to the foregoing embodiments, it will be understood by those skilled in prior art that the technical solutions described in the foregoing embodiments can be modified, or some of the technical features can be replaced by the equivalents. These modifications or substitutions are not beyond the spirit and scope of the technical solutions of the embodiments of the present disclosure.

What is claimed is:

1. A flexible sanding device for sanding a rock specimen in a shape of a cylinder, comprising:

a base;

a bottom sanding plate;

four adjustable connecting rods;

four elastic loaders;

four connectors;

four side sanding brushes;

a top sanding plate;

an inner rod;

four prongs; and a drill rod;

wherein a top of the drill rod is adapted to be fixedly connected with a rotating shaft of an external water drilling rig;

the inner rod is coaxially connected with the drill rod;

the four prongs are welded symmetrically around the drill rod;

each of the four adjustable connecting rods is connected to each of the four prongs and is inserted into each of the four connectors;

each of the four connectors is connected to each of the four side sanding brushes;

each of the four elastic loaders is arranged between one of the four adjustable connecting rods and one of the four connectors;

the four side sanding brushes are arranged around the rock specimen and configured to sand a lateral surface of the rock specimen;

the top sanding plate is connected with the inner rod through a high-strength spring and is configured to sand a first end surface of the rock specimen;

the bottom sanding plate is fixed at a center of the base and is configured to sand a second end surface of the rock specimen; and four convex grooves are evenly distributed on the base.

2. The flexible sanding device of claim 1, wherein a first end of each of the four adjustable connecting rods is a threaded rod; a second end of each of the four adjustable connecting rods is a hollow tube; each of the four elastic loaders comprises a spring and a convex spherical cylinder; the spring is disposed in the hollow tube; and one end of the spring is connected with the convex spherical cylinder.

3. The flexible sanding device of claim 2, wherein an end of each of the four connectors is provided with grooves; a cylinder cavity and a concave hemisphere are provided inside each of the four connectors; the convex spherical cylinder loader matches with the concave hemisphere; a convex body of two ends of the hollow tube is inserted into each of the four connectors for rotating connection.

4. The flexible sanding device of claim 1, wherein an end of each of the four prongs is provided with a threaded hole cooperating with the threaded rod.

5. The flexible sanding device of claim 1, wherein a geometrical shape of the base is flat cylindrical.

6. The flexible sanding device of claim 1, wherein the top sanding plate and the bottom sanding plate are thin cylinder; sides of the top sanding plate and the bottom sanding plate contacting with the rock specimen are provided with a sanding piece or a sanding coating.

* * * * *